US010191429B2

(12) United States Patent
Kamimura

(10) Patent No.: US 10,191,429 B2
(45) Date of Patent: Jan. 29, 2019

(54) IMAGE FORMING APPARATUS INCLUDING A DRUM CARTRIDGE HAVING A DETECTION GEAR

(71) Applicant: BROTHER KOGYO KABUSHIKI KAISHA, Nagoya-shi, Aichi-ken (JP)

(72) Inventor: Naoya Kamimura, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/468,806

(22) Filed: Mar. 24, 2017

(65) Prior Publication Data

US 2018/0032016 A1 Feb. 1, 2018

(30) Foreign Application Priority Data

Jul. 27, 2016 (JP) ..... 2016-147765

(51) Int. Cl.
*G03G 15/00* (2006.01)
*G03G 21/16* (2006.01)
*G03G 21/18* (2006.01)

(52) U.S. Cl.
CPC ..... *G03G 15/5062* (2013.01); *G03G 21/1647* (2013.01); *G03G 21/1821* (2013.01); *G03G 21/1896* (2013.01); *G03G 2215/00721* (2013.01)

(58) Field of Classification Search
CPC ..... G03G 15/5062
USPC ..... 399/45, 13
See application file for complete search history.

(56) References Cited

U.S. PATENT DOCUMENTS 6,298,202 B1 10/2001 Fushiya et al.
2005/0220461 A1* 10/2005 Tsusaka ..... G03G 15/6529 399/13
2010/0303478 A1 12/2010 Nakajima et al.
2014/0186058 A1* 7/2014 Shimizu ..... G03G 21/1875 399/12

(Continued)

FOREIGN PATENT DOCUMENTS

JP 2001-222204 A 8/2001
JP 2005-292357 A 10/2005

(Continued)

*Primary Examiner* — Quana M Grainger
(74) *Attorney, Agent, or Firm* — Merchant & Gould P.C.

(57) ABSTRACT

A main casing includes a driving source, a first sheet passage sensor for detecting a sheet, and a detecting sensor. A drum cartridge is detachably mounted on the main casing. The drum cartridge includes: a photosensitive drum being rotatable about a first axis extending in a first direction; a first detection gear being rotatable by receiving driving force from the driving source; and a first detection protrusion being rotatable together with the first detection gear. The first detection protrusion is arranged to contact the first sheet passage sensor. A developing cartridge is detachably mounted on the drum cartridge. The developing cartridge includes: a developing roller; a second detection gear being rotatable by receiving driving force from the driving source; and a second detection protrusion being rotatable together with the second detection gear. The second detection protrusion is arranged to contact the detecting sensor.

26 Claims, 14 Drawing Sheets

(56) References Cited

U.S. PATENT DOCUMENTS

| | | | | |
|---|---|---|---|---|
| 2014/0294403 | A1* | 10/2014 | Shimizu | G03G 21/1647 399/12 |
| 2015/0117873 | A1* | 4/2015 | Mori | G03G 21/1857 399/12 |

FOREIGN PATENT DOCUMENTS

| | | | |
|---|---|---|---|
| JP | 2010-276963 | A | 12/2010 |
| JP | 2013-114163 | A | 6/2013 |
| JP | 2014-130183 | A | 7/2014 |

* cited by examiner

IMAGE FORMING APPARATUS INCLUDING A DRUM CARTRIDGE HAVING A DETECTION GEAR

CROSS REFERENCE TO RELATED APPLICATIONS

This application claims priority from Japanese Patent Application No. 2016-147765 filed Jul. 27, 2016. The entire content of the priority application is incorporated herein by reference.

TECHNICAL FIELD

This disclosure relates to an image forming apparatus and a drum cartridge.

BACKGROUND

Conventionally, an image forming apparatus including a main casing, a drum cartridge having a photosensitive drum, and a developing cartridge having a developing roller is known.

It is disclosed that the drum cartridge and the developing cartridge are detachably mounted on the main casing. It is disclosed that the developing cartridge and the drum cartridge can be divided.

The drum cartridge includes a rotatable gear. The gear includes a protrusion. The protrusion moves by rotation of the gear and contacts a movable body of the main casing. The movable body moves by contact with the protrusion. A detecting sensor included in the main casing detects movement of the movable body. Thereby, the image forming apparatus determines whether the drum cartridge is new or used.

SUMMARY

According to one aspect, this specification discloses an image forming apparatus. The image forming apparatus includes a main casing, a drum cartridge, and a developing cartridge. The main casing includes a driving source, a first sheet passage sensor for detecting a sheet, and a detecting sensor. The drum cartridge is detachably mounted on the main casing. The drum cartridge includes: a photosensitive drum being rotatable about a first axis extending in a first direction; a first detection gear being rotatable by receiving driving force from the driving source; and a first detection protrusion being rotatable together with the first detection gear. The first detection protrusion is arranged to contact the first sheet passage sensor. The developing cartridge is detachably mounted on the drum cartridge. The developing cartridge includes: a developing roller; a second detection gear being rotatable by receiving driving force from the driving source; and a second detection protrusion being rotatable together with the second detection gear. The second detection protrusion is arranged to contact the detecting sensor.

According to another aspect, this specification also discloses a drum cartridge. The drum cartridge includes a photosensitive drum, a first conveying roller, a first detection gear, a first detection protrusion, and a transmission gear. The photosensitive drum is rotatable about a first axis extending in a first direction. The first conveying roller is rotatable about a second axis extending in the first direction, the first conveying roller conveying a sheet. The first detection gear is rotatable. The first detection protrusion is rotatable together with the first detection gear. The transmission gear is configured to transmit driving force to the first detection gear. The transmission gear is attached to the first conveying roller. The transmission gear is rotatable about the second axis together with the first conveying roller.

BRIEF DESCRIPTION OF THE DRAWINGS

Embodiments in accordance with this disclosure will be described in detail with reference to the following figures wherein.

DETAILED DESCRIPTION

The image forming apparatus described above includes a detecting sensor exclusively for the drum cartridge in order to determine whether the drum cartridge is a new product or a used product.

Therefore, there is a problem that the number of components is increased and the main casing is increased in size.

An example of an objective of this disclosure is to provide an image forming apparatus and a drum cartridge that realizes reduction of the number of components and downsizing.

1. Outline of Image Forming Apparatus 1

Figure 1:
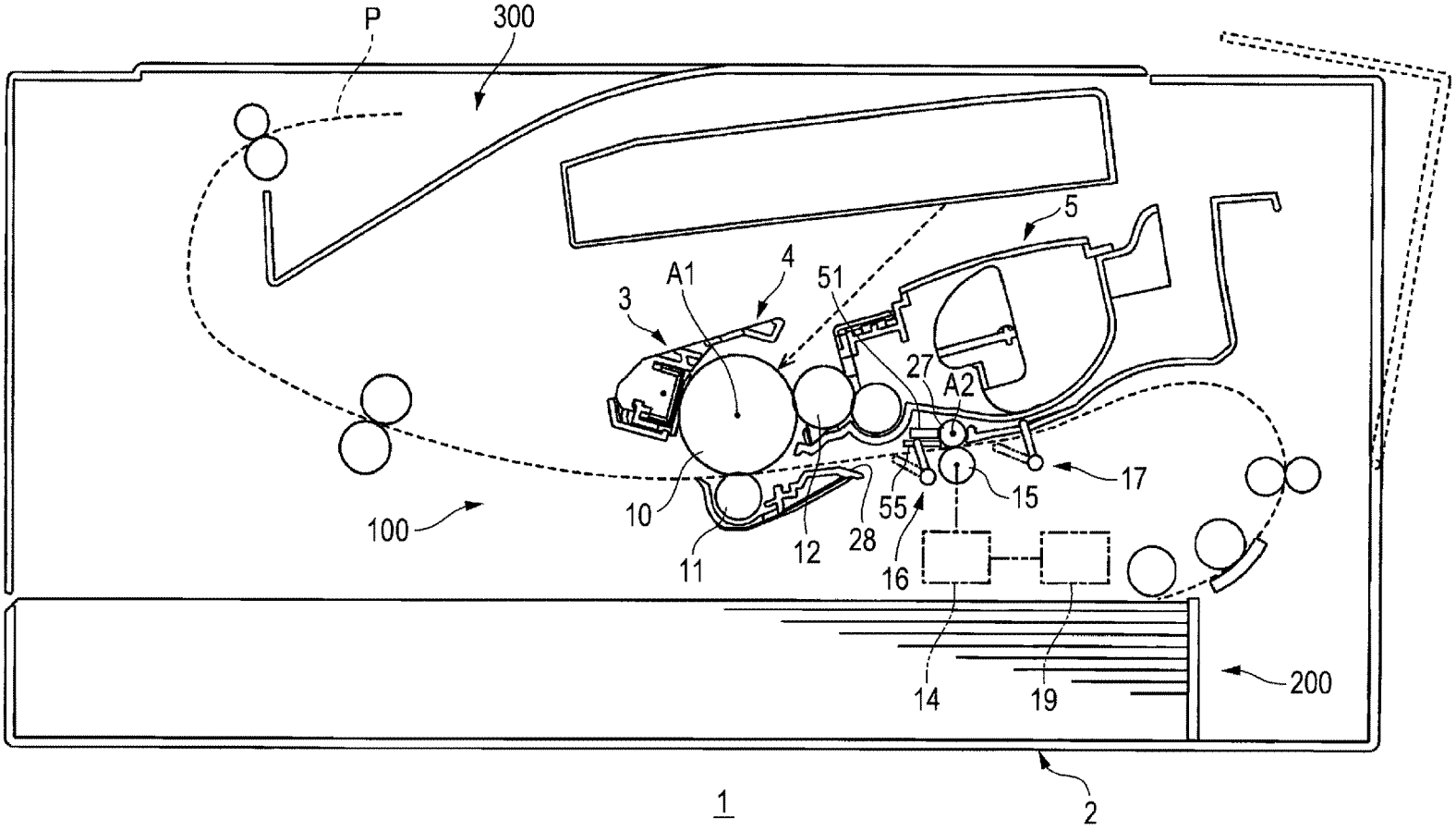
FIG. 1 is a central cross-sectional view of an image forming apparatus.

As shown in FIG. 1, an image forming apparatus 1 includes: a sheet feeding section 200 that feeds a sheet P to an image forming section 100; the image forming section 100 that forms an image on the sheet P fed from the sheet feeding section 200; a sheet discharging section 300 that discharges the sheet P on which the image is formed by the image forming section 100; and a main casing 2 that accommodates the image forming section 100, the sheet feeding section 200 and the sheet discharging section 300.

The image forming section 100 includes a process cartridge 3.

The process cartridge 3 is detachably mounted on the main casing 2. The process cartridge 3 includes a drum cartridge 4 and a developing cartridge 5.

The drum cartridge 4 includes a photosensitive drum 10, a transfer roller 11, and a first conveying roller 27.

The photosensitive drum 10 is rotatable about a first axis A1 extending in a first direction.

The transfer roller 11 is rotatable about an axis extending in the first direction. The transfer roller 11 contacts the photosensitive drum 10. The transfer roller 11 is a configuration for transferring a toner image that is on the photosensitive drum 10 to the sheet P passing between the photosensitive drum 10 and the transfer roller 11.

The first conveying roller 27 is a configuration for conveying the sheet P toward between the photosensitive drum 10 and the transfer roller 11 in state where the drum cartridge 4 is mounted on the main casing 2.

The developing cartridge 5 accommodates a toner in the inside. The developing cartridge 5 is detachably mounted on the drum cartridge 4. The developing cartridge 5 includes a developing roller 12.

The developing roller 12 is rotatable about an axis extending in the first direction. The developing roller 12 contacts the photosensitive drum 10 in state where the developing cartridge 5 is mounted on the drum cartridge 4. Thereby, the developing roller 12 can supply toner to the photosensitive drum 10.

The main casing 2 includes a driving source 14, a second conveying roller 15, a first sheet passage sensor 16, a second sheet passage sensor 17, and a controller 19.

The driving source 14 is a configuration for generating driving force. The driving source 14 is a motor, for example.

The second conveying roller 15 extends in the first direction. The second conveying roller 15 is rotatable by receiving driving force from the driving source 14. The second conveying roller 15 conveys the sheet P fed from the sheet feeding section 200 toward the photosensitive drum 10, in cooperation with the first conveying roller 27.

The second sheet passage sensor 17 is located at the upstream side of the second conveying roller 15 in a conveying direction in which the sheet P is conveyed from the sheet feeding section 200 to the image forming section 100. After the second sheet passage sensor 17 detects the sheet P, the controller 19 stops rotation of the second conveying roller 15. The sheet P abuts the second conveying roller 15 and the direction of conveyance is adjusted. After the direction of conveyance of the sheet P is adjusted, the controller 19 rotates the second conveying roller 15 again and conveys the sheet P.

The first sheet passage sensor 16 is a configuration for detecting the sheet P. The first sheet passage sensor 16 is located at the downstream side of the second conveying roller 15 and at the upstream side of the photosensitive drum 10. The first sheet passage sensor 16 detects that the sheet P passes the second conveying roller 15.

The controller 19 is arranged in the main casing 2. The controller 19 has a circuit board including an ASIC (Application Specific Integrated Circuit). The controller 19 is electrically connected to the driving source 14. The controller 19 controls the driving source 14.

2. Detail of Developing Cartridge 5

Figure 2A:
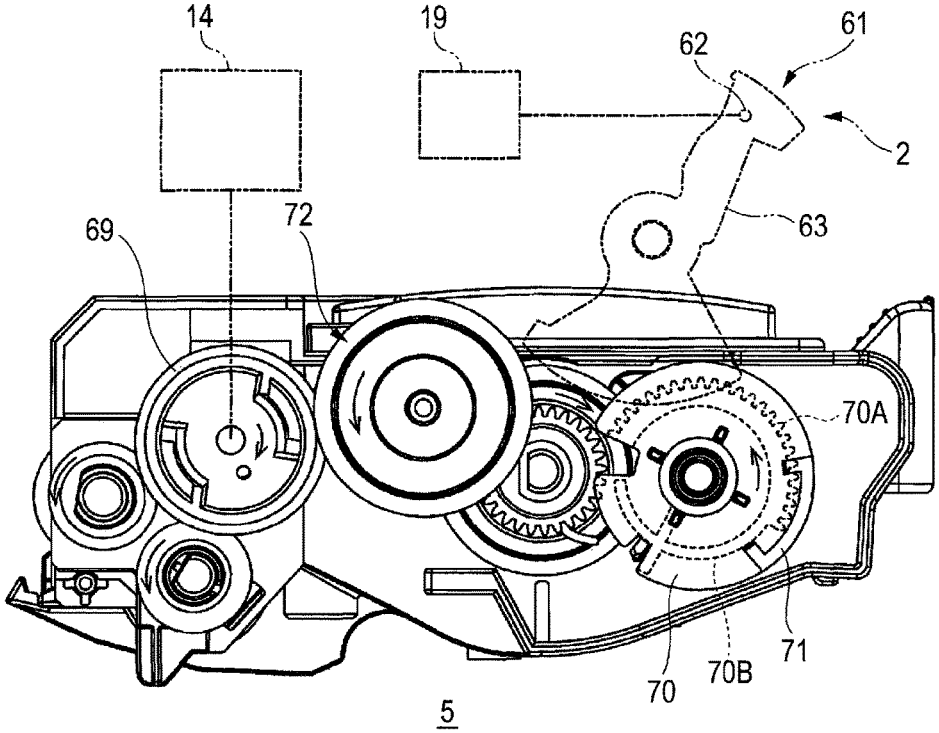
FIG. 2A is an explanatory diagram for illustrating new-product detection of a developing cartridge shown in FIG. 1.
Figure 2B:
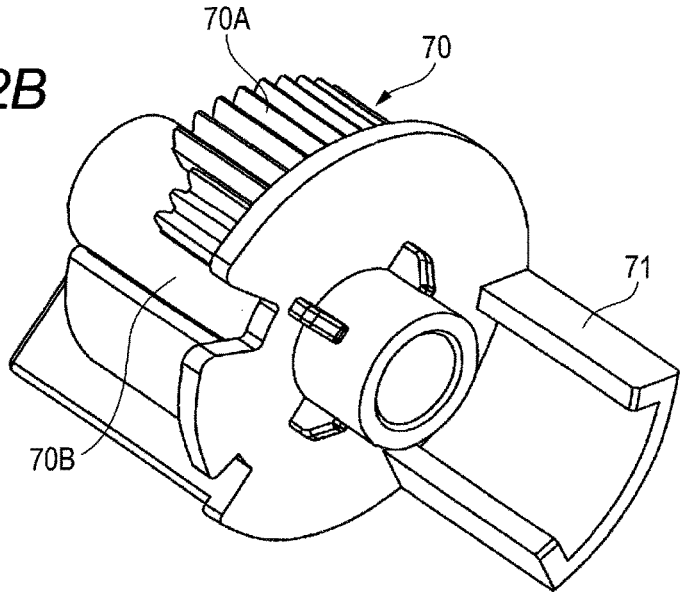
FIG. 2B is a perspective view of a second detection gear shown in FIG. 2A.

As shown in FIG. 2A and FIG. 2B, the developing cartridge 5 includes a coupling 69 and a second detection gear 70.

The coupling 69 is a configuration for receiving driving force from the driving source 14. The driving force received by the coupling 69 is transmitted via a gear train 72 to the second detection gear 70. That is, the second detection gear 70 is configured to be rotatable by receiving driving force from the driving source 14.

The second detection gear 70 includes a gear portion 70A, a toothless portion 70B, and a second detection protrusion 71.

The gear portion 70A is provided in a part of a periphery of the second detection gear 70. The gear portion 70A has a plurality of gear teeth. The toothless portion 70B is a portion where the gear portion 70A is not provided in the periphery of the second detection gear 70. The toothless portion 70B is arranged side by side with the gear portion 70A in a rotational direction of the second detection gear 70. The toothless portion 70B does not engage the gear train 72. The second detection gear 70 does not receive driving force from the gear train 72 in a state where the toothless portion 70B faces the gear train 72.

The second detection protrusion 71 protrudes from the second detection gear 70. The second detection protrusion 71 is configured integrally with the second detection gear 70. Thereby, the second detection protrusion 71 is rotatable with the second detection gear 70. The second detection protrusion 71 is detected by a detecting sensor 61 provided in the main casing 2 in a state where the developing cartridge 5 is mounted on the main casing 2. Specifically, the main casing 2 includes the detecting sensor 61. The detecting sensor 61 is a configuration for detecting information on the developing cartridge 5. The detecting sensor 61 includes a lever 63 and an optical sensor 62.

The lever 63 rotatably moves between a non-detection position and a detection position. Specifically, in a state where the developing cartridge 5 is mounted on the main casing 2 and the second detection protrusion 71 rotates, the lever 63 contacts the second detection protrusion 71, thereby rotatably moves from the non-detection position to the detection position.

The optical sensor 62 is electrically connected to the controller 19. The optical sensor 62 stops transmission of a detection signal to the controller 19 in a state where the lever 63 is located at the non-detection position. The optical sensor 62 transmits the detection signal to the controller 19 in a state where the lever 63 is located at the detection position. Specifically, in a state where the lever 63 is located at the non-detection position, the lever 63 interrupts detection light of the optical sensor 62, and therefore the detection signal is not transmitted. In a state where the lever 63 is located the detection position, the lever 63 does not interrupt the detection light of the optical sensor 62, and therefore the detection signal is transmitted. The controller 19 determines information on the developing cartridge 5 by using a pattern formed by the detection signal from the optical sensor 62. The information on the developing cartridge 5 is whether the developing cartridge 5 is a new product or a used product, and the specification of the developing cartridge 5.

3. Detail of Drum Cartridge 4

Figure 3:
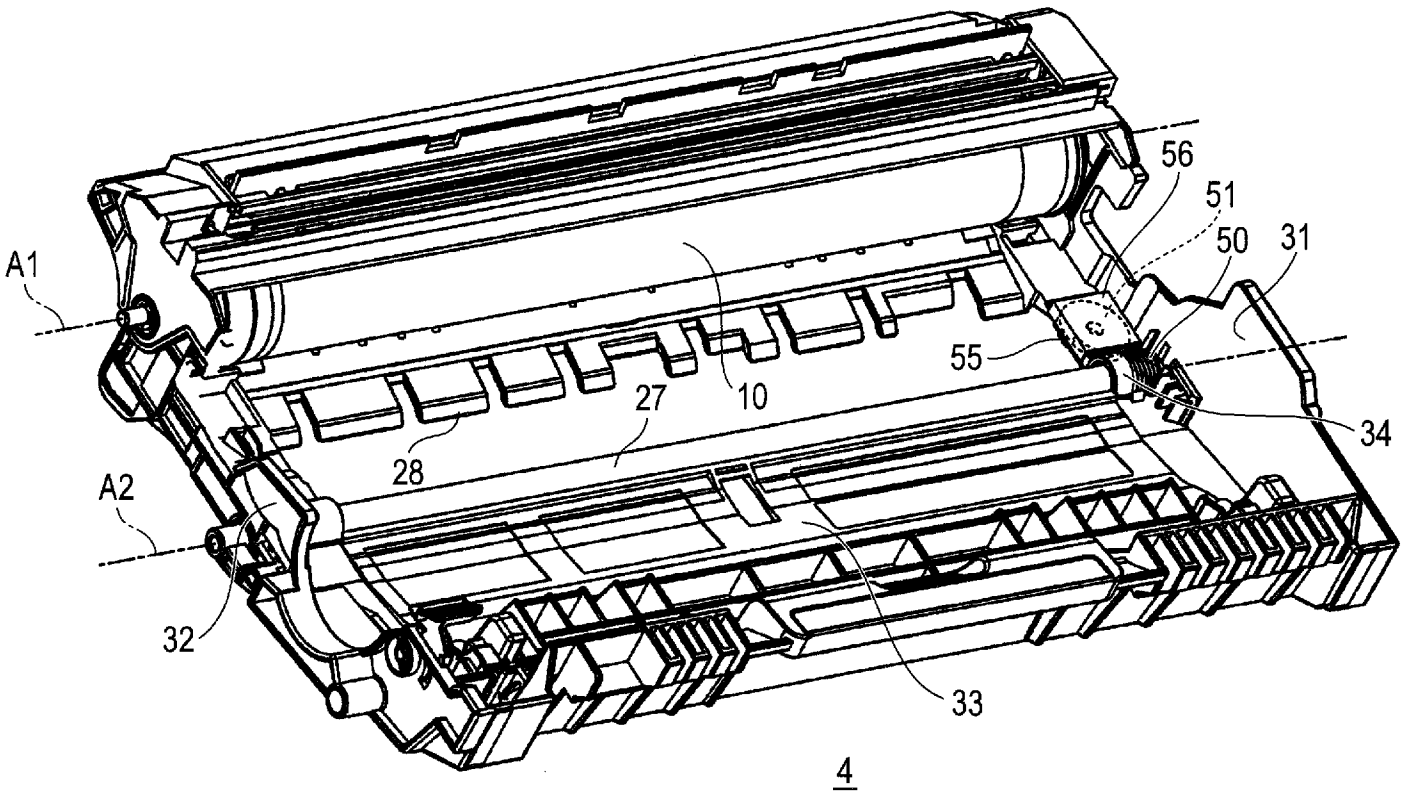
FIG. 3 is a perspective view of a drum cartridge shown in FIG. 1.

As shown in FIG. 3, the drum cartridge 4 includes a first wall 31, a second wall 32, and a third wall 33.

The first wall 31 and the second wall 32 are located spaced away from each other in the first direction. The first wall 31 is located at one end of the drum cartridge 4 in the first direction. The second wall 32 is located at an other end of the drum cartridge 4 in the first direction. The first wall 31 and the second wall 32 rotatably support the photosensitive drum 10.

The third wall 33 is located between the first wall 31 and the second wall 32 in the first direction. The third wall 33 extends in the first direction and in the conveying direction of the sheet P. As shown in FIG. 1 and FIG. 3, the third wall 33 has an opening 28.

The opening 28 extends in the first direction. In a state where the drum cartridge 4 is mounted on the main casing 2, the opening 28 is located between the second conveying roller 15 and the photosensitive drum 10 in the conveying direction of the sheet P. Thereby, the sheet P conveyed to the photosensitive drum 10 by the second conveying roller 15 passes the opening 28.

The first conveying roller 27 is located in the opening 28. Specifically, the opening 28 has a one end portion near the photosensitive drum 10 and an other end portion farther away from the photosensitive drum 10 than the one end portion is in the conveying direction of the sheet P. The first conveying roller 27 is located at the other end portion of the opening 28. The first conveying roller 27 is supported by the first wall 31 and the second wall 32. The first conveying roller 27 is rotatable about a second axis A2 extending in the first direction. In a state where the drum cartridge 4 is mounted on the main casing 2, the first conveying roller 27 contacts the second conveying roller 15. The first conveying roller 27 rotates along with rotation of the second conveying roller 15 while contacting the second conveying roller 15. Thereby, the first conveying roller 27 conveys the sheet P together with the second conveying roller 15. The sheet P conveyed by the first conveying roller 27 passes the opening 28 and is conveyed toward between the photosensitive drum 10 and the transfer roller 11.

Figure 4:
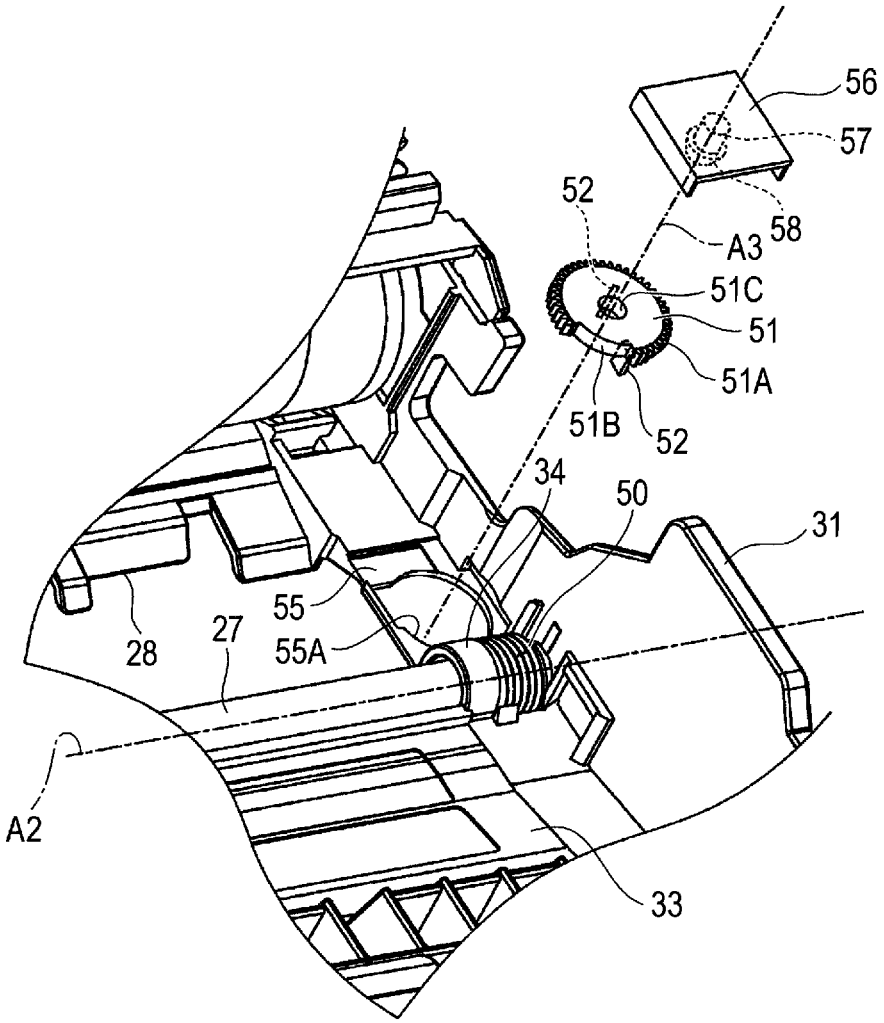
FIG. 4 is an exploded perspective view of an enlarged transmission gear, a first detection gear, a protection wall, and a cover of the drum cartridge shown in FIG. 3.

As shown in FIG. 3 and FIG. 4, the drum cartridge 4 includes a transmission gear 50 and a first detection gear 51.

3.1 Detail of Transmission Gear 50

The transmission gear 50 is attached to an end portion of the first conveying roller 27 in a state where the transmission gear 50 is not movable relative to the first conveying roller 27. The transmission gear 50 is located closer to the first wall 31 than the opening 28 is in the first direction. The transmission gear 50 is located between the first wall 31 and a stopper 34 provided at the third wall 33. The stopper 34 extends along a peripheral surface of the first conveying roller 27. An inner diameter of the stopper 34 is smaller than an outer diameter of the transmission gear 50. Thereby, when the transmission gear 50 moves toward the stopper 34 in the first direction, the transmission gear 50 contacts the stopper 34 and stops. The transmission gear 50 is rotatable about the second axis A2 together with the first conveying roller 27. The transmission gear 50 is a worm.

3.2 Detail of First Detection Gear 51

The first detection gear 51 is a worm wheel. The first detection gear 51 constitutes a worm gear, together with the transmission gear 50.

An outer diameter of the first detection gear 51 is larger than the outer diameter of the transmission gear 50. The first detection gear 51 is rotatable about a third axis A3 extending in a second direction. Therefore, an increase in size of the drum cartridge in the second direction is suppressed.

As shown in FIG. 1, in a state where the developing cartridge 5 is mounted on the drum cartridge 4, the first detection gear 51 is located between the developing cartridge 5 and the first sheet passage sensor 16 in the second direction perpendicular to the first direction. As shown in FIG. 3 and FIG. 4, the first detection gear 51 is located between the opening 28 and the first wall 31 in the first direction. In a state where the drum cartridge 4 is mounted on the main casing 2, the first detection gear 51 is located between the first conveying roller 27 and the photosensitive drum 10 in the conveying direction of the sheet P.

As shown in FIG. 4, the third wall 33 has a protection wall 55. The protection wall 55 is a part of the third wall 33. The protection wall 55 is located between the opening 28 and the first wall 31 in the first direction. As shown in FIG. 1, in a state where the drum cartridge 4 is mounted on the main casing 2, the protection wall 55 is located between the first conveying roller 27 and the photosensitive drum 10 in the conveying direction of the sheet P. In a state where the developing cartridge 5 is mounted on the drum cartridge 4, the protection wall 55 is located at the opposite side of the developing cartridge 5 with respect to the first detection gear 51 in the second direction. In a state where the drum cartridge 4 is mounted on the main casing 2, the protection wall 55 is located between the first sheet passage sensor 16 and the first detection gear 51 in the second direction. As shown in FIG. 4, the protection wall 55 has an opening 55A.

The opening 55A is formed through the protection wall 55 in the second direction. The opening 55A has a substantially circular shape. The outer diameter of the first detection gear 51 is larger than the opening 55A of the protection wall 55. A peripheral edge portion of the first detection gear 51 is covered by an edge of the opening 55A in the protection wall 55.

As shown in FIG. 3 and FIG. 4, the drum cartridge 4 further includes a cover 56. The cover 56 is located at the opposite side of the protection wall 55 with respect to the first detection gear 51 in the second direction. The cover 56 covers the first detection gear 51. In a state where the developing cartridge 5 is mounted on the drum cartridge 4, the cover 56 is located between the developing cartridge 5 and the first detection gear 51.

Figure 5:
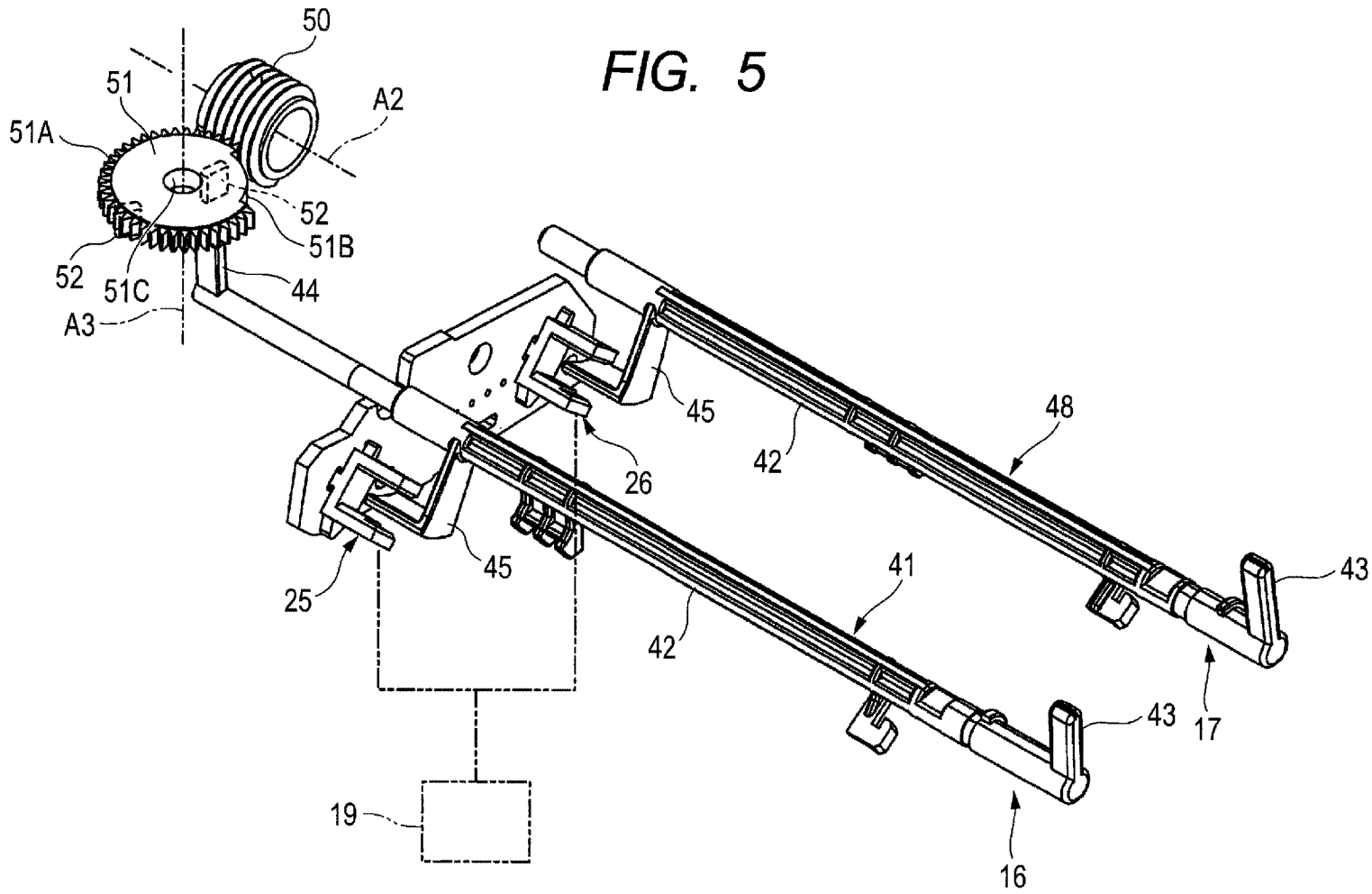
FIG. 5 is a perspective view of a first sheet passage sensor and a second sheet passage sensor shown in FIG. 1.

The cover 56 has a boss 57. The boss 57 extends from the cover 56 toward the first detection gear 51 in the second direction. The boss 57 extends to the opposite side of the cover 56 with respect to the first detection gear 51. The boss 57 fits in a hole 51C formed through the first detection gear 51 in the second direction. An end portion 58 of the boss 57 is larger than a diameter of the boss 57. As shown in FIG. 4 and FIG. 5, the first detection gear 51 is supported by the cover 56 and is rotatable about the third axis A3. In other words, the boss 57 rotatably supports the first detection gear 51. The third axis A3 extends in the direction in which the second conveying roller 15 and the first conveying roller 27 are arranged. In other words, the third axis A3 extends in the second direction. Specifically, the first direction is perpendicular to the second direction.

The first detection gear 51 includes a gear portion 51A, a toothless portion 51B, and a plurality of, namely two first detection protrusions 52.

The gear portion 51A is provided in a part of a periphery of the first detection gear 51. The gear portion 51A has a plurality of gear teeth.

The toothless portion 51B is a portion where the gear portion 51A is not provided in the periphery of the first detection gear 51. The toothless portion 51B is arranged side by side with the gear portion 51A in a rotational direction of the first detection gear 51.

The two first detection protrusions 52 are located spaced away from each other in the rotational direction of the first detection gear 51. The first detection protrusions 52 extend from the first detection gear 51 toward the first sheet passage sensor 16 in the second direction. The first detection protrusions 52 extend in the second direction. The first detection protrusions 52 extend from the first detection gear 51. That is, the first detection protrusions 52 are integrally formed with the first detection gear 51. Thereby, the first detection protrusions 52 are rotatable together with the first detection gear 51. The first detection protrusions 52 are arranged to contact the first sheet passage sensor 16. Specifically, the first detection protrusions 52 are arranged to contact a lever 41 (described later) of the first sheet passage sensor 16.

The two first detection protrusions 52 are exposed from the opening 55A.

The first detection gear 51 is movable from an engagement position to an engagement release position. The gear portion 51A engages the transmission gear 50 in a state where the first detection gear 51 is in the engagement position. Specifically, when the first detection gear 51 is in the engagement position, the transmission gear 50 engages the gear portion 51A of the first detection gear 51. While the transmission gear 50 engages the gear portion 51A, the transmission gear 50 transmits driving force from the driving source 14 to the first detection gear 51. Thereby, the first detection gear 51 is rotatable by receiving driving force from the driving source 14. In a state where the transmission gear 50 and the toothless portion 51B face each other, engagement between the gear portion 51A and the transmission gear 50 is released and the first detection gear 51 is located at the engagement release position. That is, the toothless portion 51B does not engage the transmission gear 50 in the engagement release position. Thereby, driving force from the transmission gear 50 is not transmitted to the first detection gear 51. In this way, the first detection gear 51 moves from the position where the first detection gear 51 engages the transmission gear 50 to the position where engagement with the transmission gear 50 is released.

4. Detail of Main Casing 2

4.1 First Sheet Passage Sensor 16 and Second Sheet Passage Sensor 17

Figure 6:
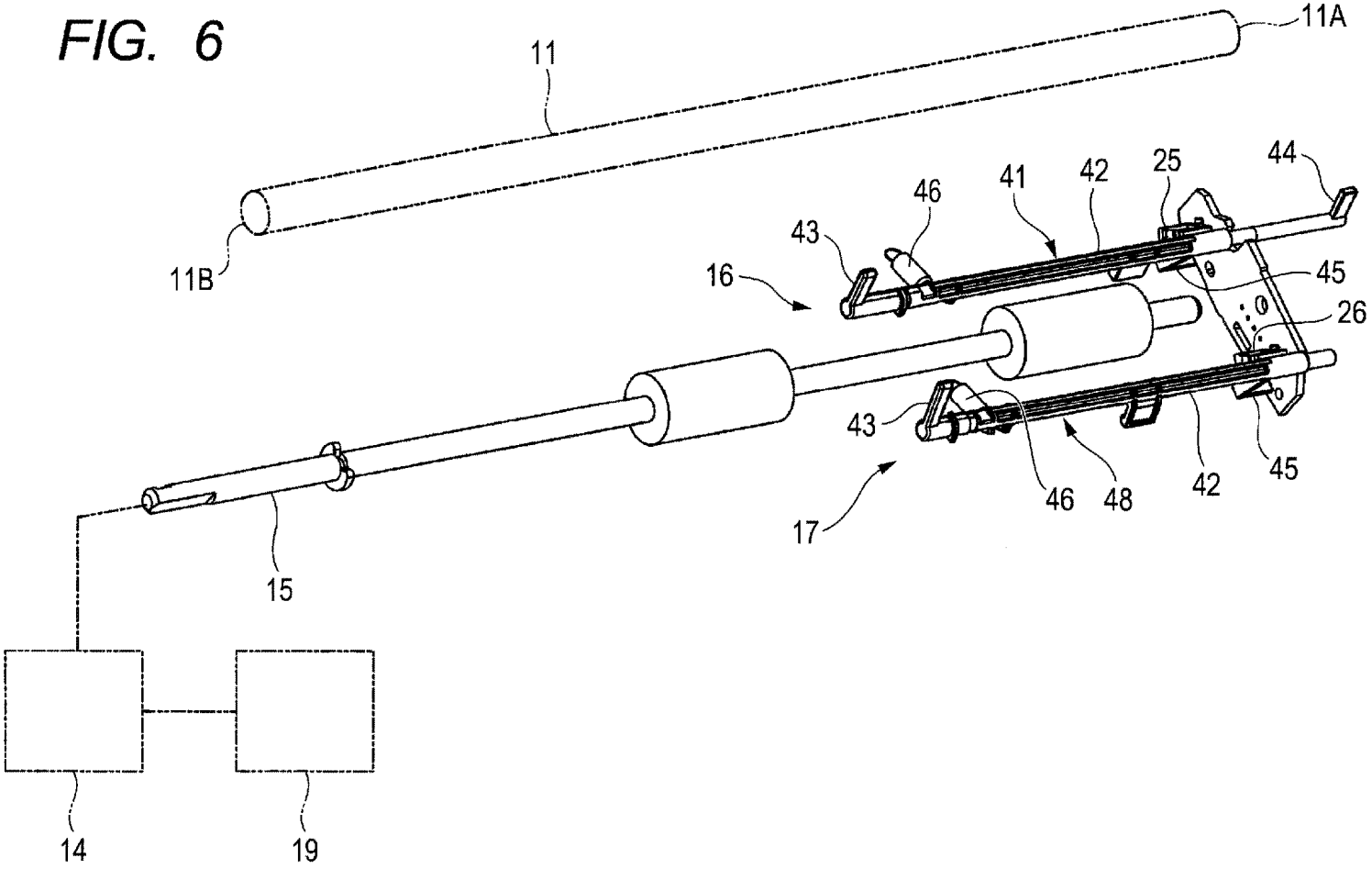
FIG. 6 is a perspective view showing a second conveying roller, the first sheet passage sensor, and the second sheet passage sensor shown in FIG. 1.

As shown in FIG. 5 and FIG. 6, the first sheet passage sensor 16 includes the lever 41 and an optical sensor 25.

Figure 10B:
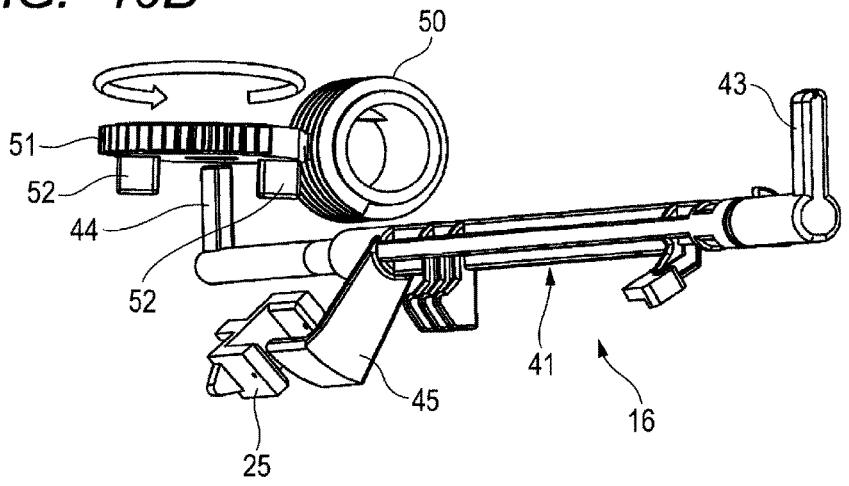
FIG. 10B is a perspective view of the transmission gear, the first detection gear, and the first sheet passage sensor shown in FIG. 10A.
Figure 11A:
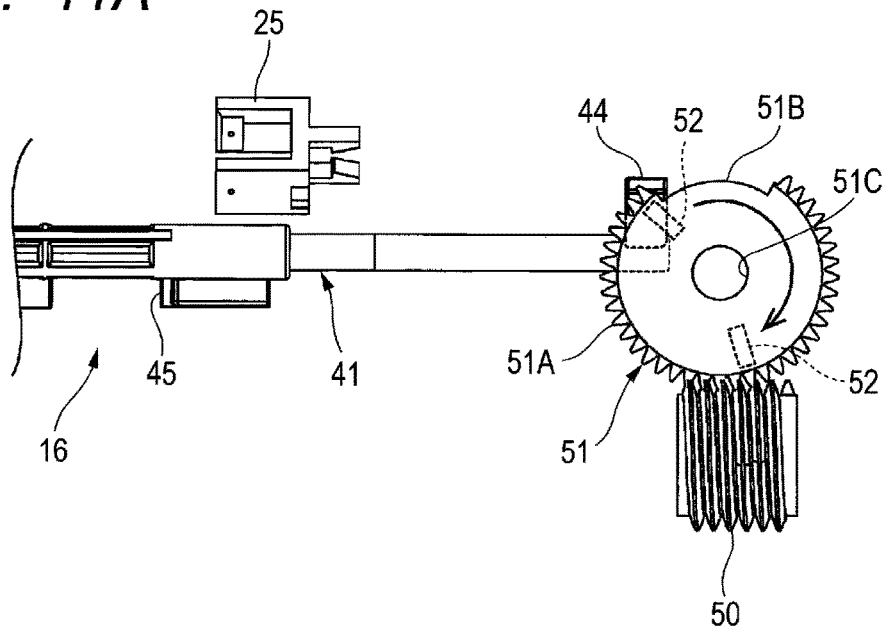
FIG. 11A is an explanatory diagram for illustrating a state where one first detection protrusion contacts the second protrusion and the lever is located at the second position.
Figure 11B:
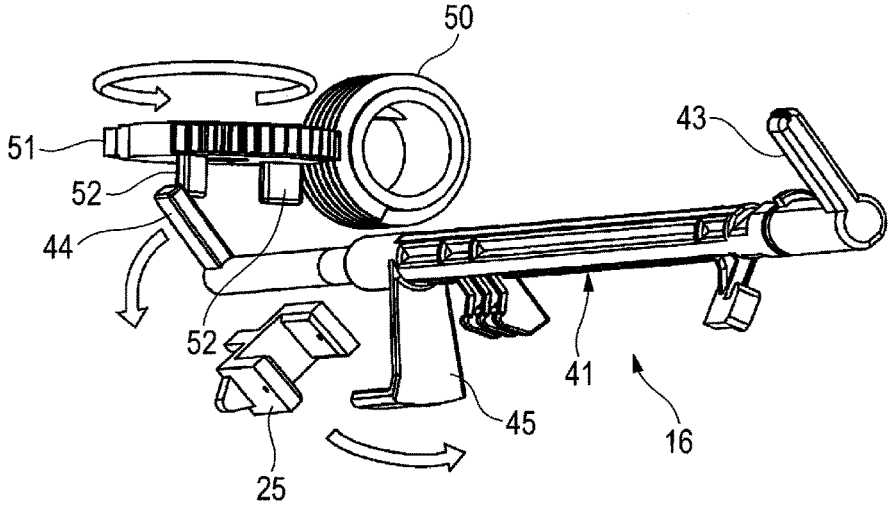
FIG. 11B is a perspective view of the transmission gear, the first detection gear, and the first sheet passage sensor shown in FIG. 11A.
Figure 12B:
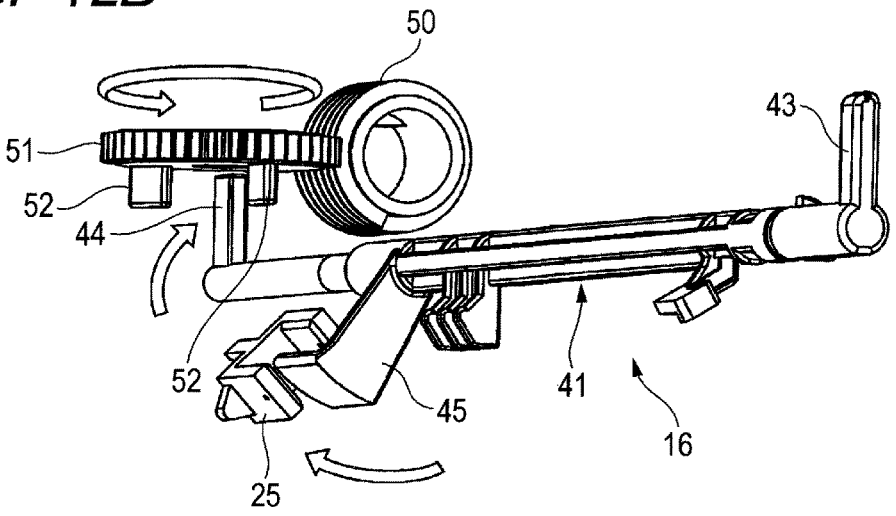
FIG. 12B is a perspective view of the transmission gear, the first detection gear, and the first sheet passage sensor shown in FIG. 12A.
Figure 13A:
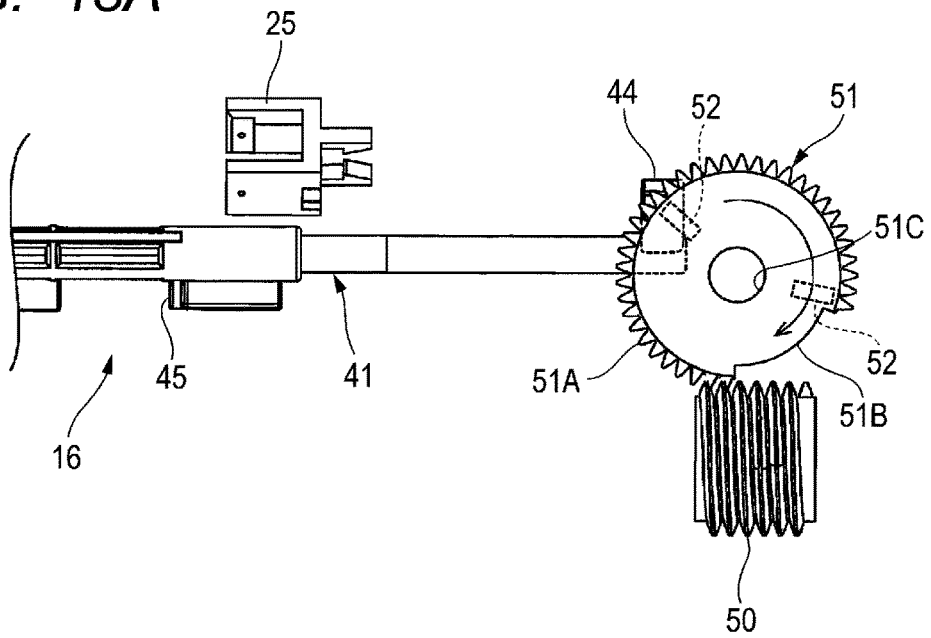
FIG. 13A is an explanatory diagram for illustrating a state where the other first detection protrusion contacts the second protrusion and the lever is located at the second position.
Figure 13B:
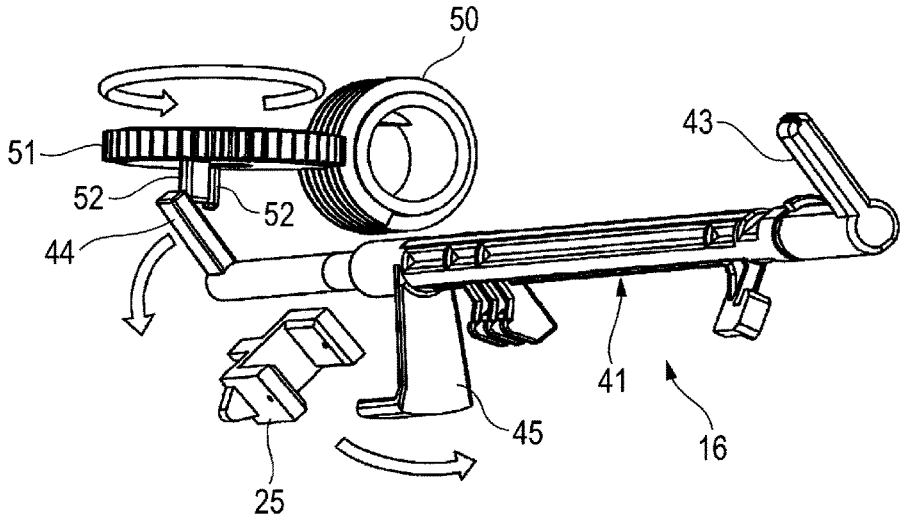
FIG. 13B is a perspective view of the transmission gear, the first detection gear, and the first sheet passage sensor shown in FIG. 13A.

The lever 41 is movable between a first position (see FIG. 5, FIG. 10B, FIG. 12B, and FIG. 14B) and a second position (see FIG. 11B and FIG. 13B). Specifically, the lever 41 can rotatably move between the first position and the second position.

The lever 41 includes a main body 42, a first protrusion 43, and a light blocking portion 45. The main body 42 extends in the first direction. The main body 42 is rotatable about an axis extending in the first direction. The first protrusion 43 extends in a radial direction of the main body 42. In the first direction, the first protrusion 43 is located between a one end 11A of the transfer roller 11 in the first direction, and an other end 11B of the transfer roller 11 in the first direction. Specifically, the first protrusion 43 is located at a center of the transfer roller 11 in the first direction. The light blocking portion 45 extends from the main body 42 to a radial direction of the main body 42.

Figure 7:
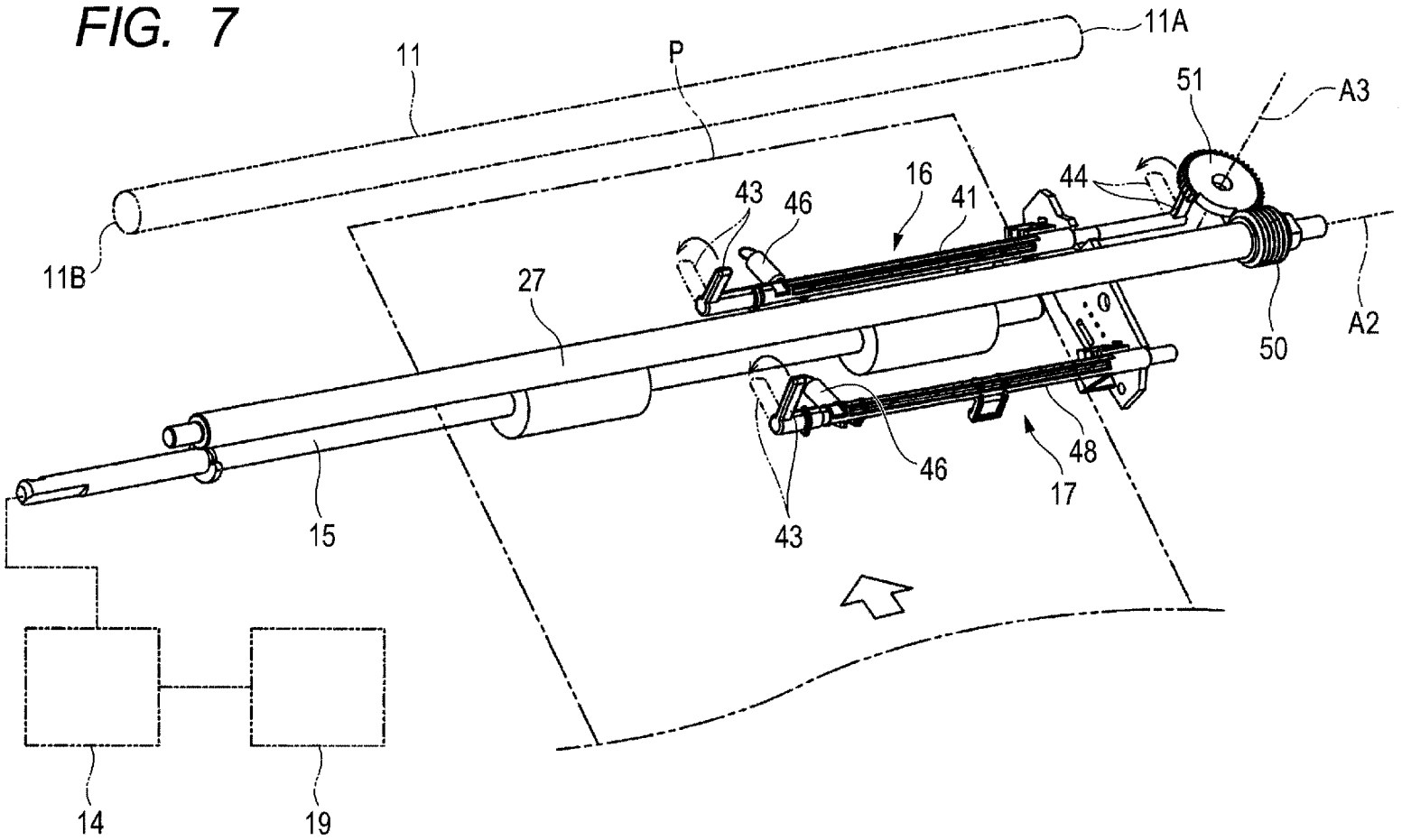
FIG. 7 is a perspective view showing a state where a sheet passes between the second conveying roller and the first conveying roller shown in FIG. 1.

As shown in FIG. 1 and FIG. 7, in a state where the lever 41 is located at the first position, the first protrusion 43 is located in a conveying path of the sheet P. In a state where the lever 41 is located at the second position, as shown in a virtual line in FIG. 1 and FIG. 7, the first protrusion 43 is located outside the conveying path of the sheet P. The first protrusion 43 is configured to contact the sheet P conveyed during image formation.

The sheet P passes the conveying path to contact the first protrusion 43 of the lever 41 and rotatably moves the lever 41 from the first position to the second position. As shown in FIG. 6, the lever 41 is usually pulled by a spring 46 so as to be located at the first position. Therefore, in a state where the sheet P does not pass, the lever 41 is usually located at the first position.

As shown in FIG. 5, an optical sensor 25 is electrically connected to the controller 19. In a state where the lever 41 is located at the first position, the optical sensor 25 does not transmit the detection signal to the controller 19. In a state where the lever 41 is located at the second position, the optical sensor 25 transmits the detection signal to the controller 19. Specifically, in a state where the lever 41 is located at the first position, the light blocking portion 45 blocks the detection light of the optical sensor 25, and thereby the detection signal is not transmitted. In a state where the lever 41 is located at the second position, the light blocking portion 45 does not block the detection light of the optical sensor 25, and thereby the detection signal is transmitted. The controller 19 determines whether the lever 41 is located at the first position or located at the second position based on the presence of the detection signal from the optical sensor 25.

In this way, the optical sensor 25 is configured to detect movement of the lever 41 from the first position to the second position.

The first sheet passage sensor 16 is turned off when the optical sensor 25 is detecting that the lever 41 is located at the first position. The first sheet passage sensor 16 is turned on when the optical sensor 25 is detecting that the lever 41 is located at the second position.

As shown in FIG. 5 and FIG. 6, the second sheet passage sensor 17 includes a lever 48 and an optical sensor 26. The lever 48 has the same configuration as the lever 41 of the first sheet passage sensor 16. The optical sensor 26 has the same configuration as the optical sensor 25 of the first sheet passage sensor 16.

The second sheet passage sensor 17 is turned off when the optical sensor 26 is detecting that the lever 48 is located at the first position. The second sheet passage sensor 17 is turned on when the optical sensor 26 is detecting that the lever 48 is located at the second position.

4.2 Second Protrusion 44

The lever 41 of the first sheet passage sensor 16 includes a second protrusion 44. Specifically, the main body 42 of the first sheet passage sensor 16 is longer than the main body 42 of the second sheet passage sensor 17 in the first direction. The main body 42 of the first sheet passage sensor 16 extends to a position closer to the first detection gear 51 than the main body 42 of the second sheet passage sensor 17 is. The second protrusion 44 extends from the main body 42 of the first sheet passage sensor 16 to the radial direction of the main body 42. The second protrusion 44 extends toward the same direction as the first protrusion 43. In the first direction, the second protrusion 44 is located at the opposite side of the other end 11B of the transfer roller 11 in the first direction with respect to the one end 11A of the transfer roller 11 in the first direction. The second protrusion 44 is located spaced away from each other with the first protrusion 43, in the first direction. The second protrusion 44 is located at an overlapping position with the first detection gear 51 when viewed from the second direction. The second protrusion 44 is located on a rotational locus of the first detection protrusions 52. Thereby, the second protrusion 44 is configured to contact the first detection protrusions 52. The second protrusion 44 contacts the first detection protrusions 52 via the opening 55A of the protection wall 55.

5. New-Product Detection Operation of Drum Cartridge 4

Next, a new-product detection operation of the drum cartridge 4 will be described while referring to FIG. 8 to FIG. 14B.

First, the process cartridge 3 is mounted on the main casing 2. Then, driving force is inputted to the process cartridge 3. Thereby, the controller 19 determines information on the developing cartridge 5 as described above.

Figure 8:
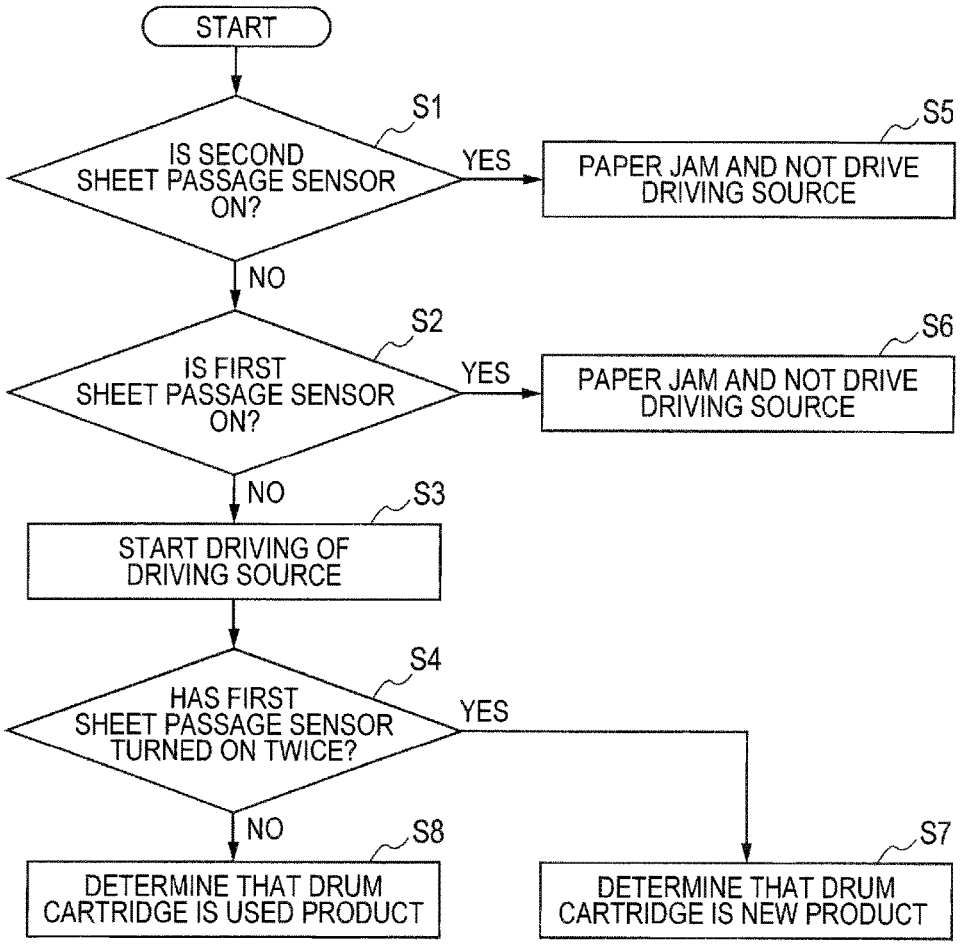
FIG. 8 is a flowchart for describing new-product detection of a drum cartridge.

As shown in FIG. 8, the controller 19 determines on/off of the second sheet passage sensor 17 (S1).

When the controller 19 determines that the second sheet passage sensor 17 is on (S1: Yes), the controller 19 recognizes that the sheet P is jammed in a position of contacting the lever 48. Therefore, the controller 19 does not drive the driving source 14 (S5).

When the controller 19 determines that the second sheet passage sensor 17 is off (S1: No), the controller 19 recognizes that the sheet P is not jammed in the position of contacting the lever 48.

Next, the controller 19 determines on/off of the first sheet passage sensor 16 (S2).

When the controller 19 determines that the first sheet passage sensor 16 is on (S2: Yes), the controller 19 recognizes that the sheet P is jammed in the position of contacting the lever 41. Therefore, the controller 19 does not drive the driving source 14 (S6).

In this way, in a state where the driving source 14 does not drive the first detection gear 51, when the optical sensor 26 detects that the lever 41 of the first sheet passage sensor 16 is located at the second position, the controller 19 does not drive the driving source 14.

Figure 9:
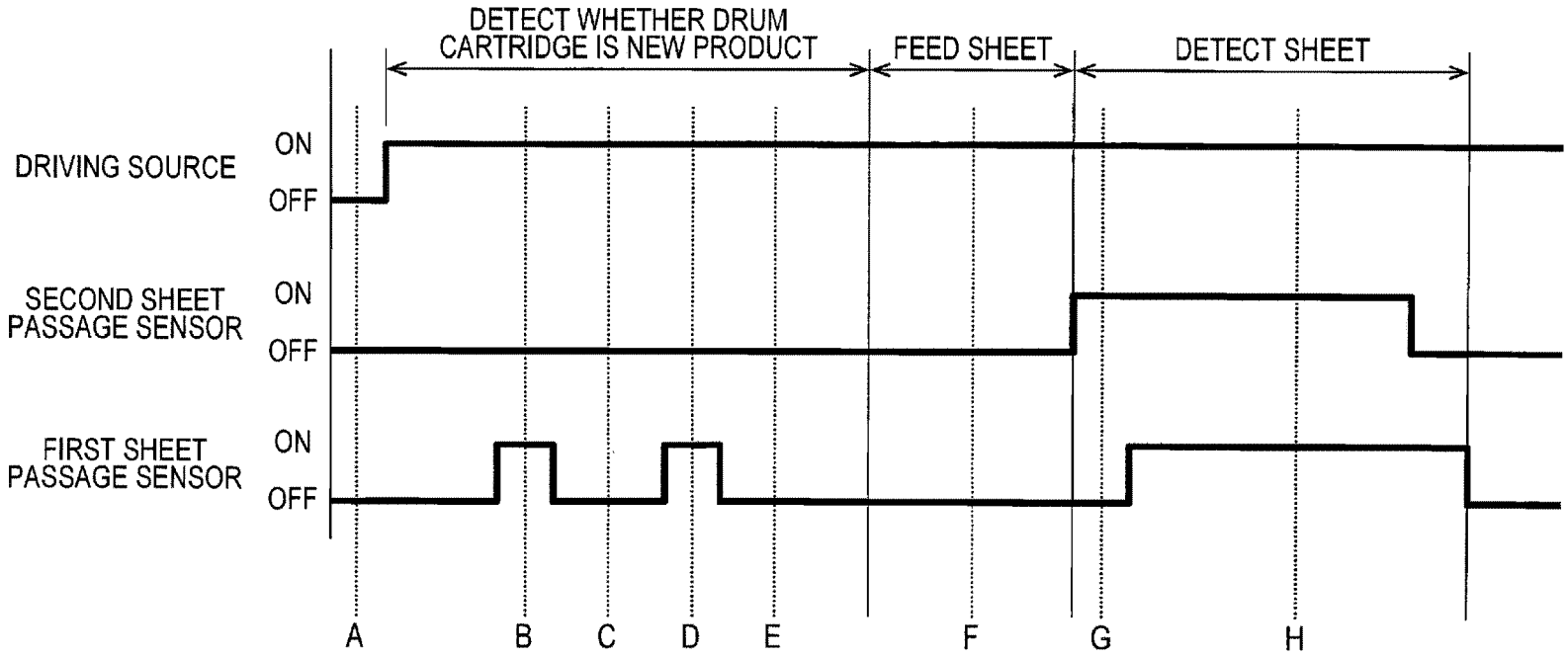
FIG. 9 is a timing chart for describing new-product detection of a drum cartridge.
Figure 10A:
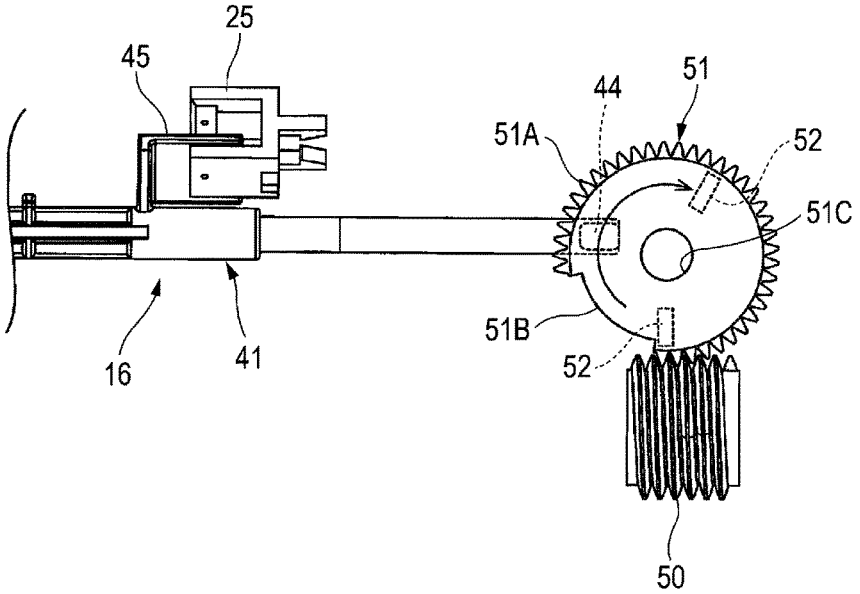
FIG. 10A is an explanatory diagram for illustrating a state where a lever is located at the first position before first detection protrusions contacts a second protrusion.

At this time, as shown in FIG. 10A and FIG. 10B, the first detection protrusions 52 are away from the second protrusion 44. Therefore, the light blocking portion 45 blocks the detection light of the optical sensor 25. Thereby, the first sheet passage sensor 16 is turned off. The controller 19 determines that the lever 41 is located at the first position (see timing A in FIG. 9).

When the controller 19 determines that the first sheet passage sensor 16 is off (S2: No), the controller 19 recognizes that the sheet P is not jammed in the position of contacting the lever 41. Then, the controller 19 drives the driving source 14 (S3, see FIG. 8).

As shown in FIG. 7, the second conveying roller 15 rotates by receiving driving force from the driving source 14. When the second conveying roller 15 rotates, the first conveying roller 27 of the drum cartridge 4 rotates together. When the first conveying roller 27 rotates, the transmission gear 50 rotates. When the transmission gear 50 rotates, the first detection gear 51 rotates.

As shown in FIG. 11A and FIG. 11B, when the first detection gear 51 rotates, one of the first detection protrusions 52 contacts the second protrusion 44 and brings down the second protrusion 44. Then, the light blocking portion 45 does not block the detection light of the optical sensor 25 and transmits the detection signal. Thereby, the first sheet passage sensor 16 is turned on. The controller 19 determines that the lever 41 is located at the second position (see timing B in FIG. 9).

Figure 12A:
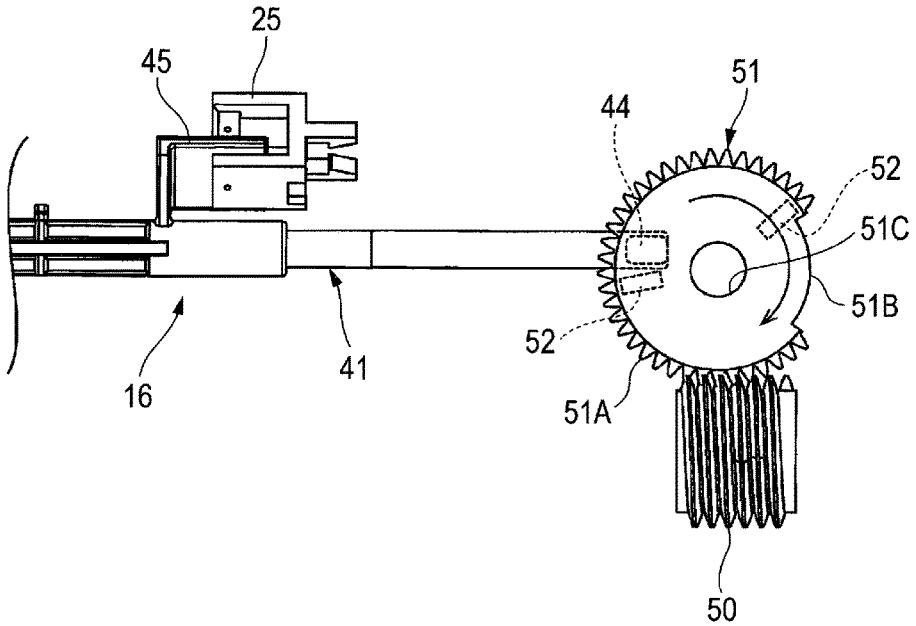
FIG. 12A is an explanatory diagram for illustrating a state where the lever is located at the first position after the one first detection protrusion passes the second protrusion and before the other first detection protrusion contacts the second protrusion.

As shown in FIG. 12A and FIG. 12B, when the first detection gear 51 rotates, one of the first detection protrusions 52 separates from the second protrusion 44. Then, the lever 41 moves from the second position to the first position by being pulled by the spring 46 (see FIG. 6 and FIG. 7). The light blocking portion 45 blocks the detection light of the optical sensor 25 and the detection signal is not transmitted. Thereby, the first sheet passage sensor 16 is turned off, and the controller 19 determines that the lever 41 is located at the first position (see timing C in FIG. 9).

As shown in FIG. 13A and FIG. 13B, when the first detection gear 51 rotates, the other one of the first detection protrusions 52 contacts the second protrusion 44 and brings down the second protrusion 44. Then, the light blocking portion 45 does not block the detection light of the optical sensor 25 and transmits the detection signal. Thereby, the first sheet passage sensor 16 is turned on. The controller 19 determines that the lever 41 is located at the second position (see timing D in FIG. 9).

Figure 14A:
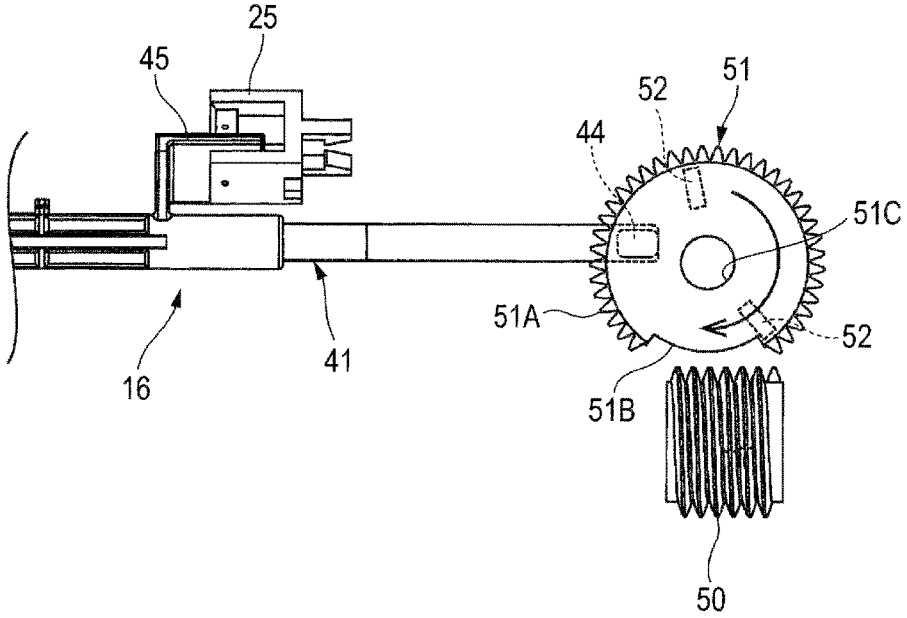
FIG. 14A is an explanatory diagram for illustrating a state where the other first detection protrusion passes the second protrusion, and a toothless portion of the first detection gear faces the transmission gear, and thereby driving of the first detection gear is stopped.
Figure 14B:
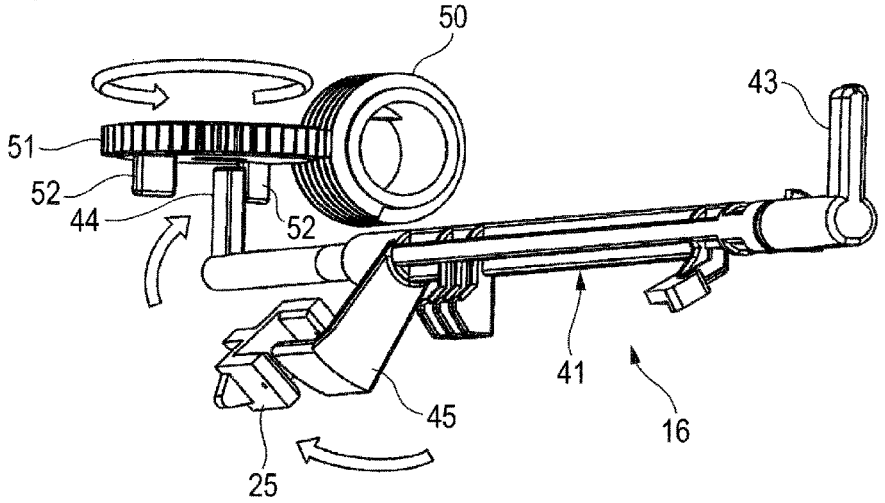
FIG. 14B is a perspective view of the transmission gear, the first detection gear, and the first sheet passage sensor shown in FIG. 14A.

As shown in FIG. 14A and FIG. 14B, when the first detection gear 51 rotates, the other one of the first detection protrusions 52 separates from the second protrusion 44. The lever 41 moves from the second position to the first position by being pulled by the spring 46 (see FIG. 6 and FIG. 7). The light blocking portion 45 blocks the detection light of the optical sensor 25 and the detection signal is not transmitted. Thereby, the first sheet passage sensor 16 is turned off. The controller 19 determines that the lever 41 is located at the first position (see timing E in FIG. 9).

After that, when the first detection gear 51 further rotates, engagement between the gear portion 51A and the transmission gear 50 is released. Then, the toothless portion 51B of the first detection gear 51 faces the transmission gear 50. Thereby, the first detection gear 51 does not receive driving force from the driving source 14 and does not rotate. Note that, as shown in FIG. 14A, the toothless portion 51B and the other one of the first detection protrusions 52 (the first detection protrusion 52 that contacts the second protrusion 44 finally) are located at opposite sides the first detection gear 51. Thus, when the other one of the first detection protrusions 52 separates from the second protrusion 44, the toothless portion 51B faces the transmission gear 50, and engagement between the first detection gear 51 and the transmission gear 50 is released.

In this way, the controller 19 determines on/off of the first sheet passage sensor 16 (S4, see FIG. 8). When the controller 19 determines that the first sheet passage sensor 16 has turned on twice as described above (S4: Yes), the controller 19 determines that the drum cartridge 4 is a new product (S7). When the controller 19 determines that the first sheet passage sensor 16 is off (S4: No), the controller 19 determines that the drum cartridge 4 is a used product (S8).

After that, as shown in FIG. 7, the sheet P is fed to the image forming section 100 (see timing F in FIG. 9).

The fed sheet P contacts the first protrusion 43 of the lever 48 of the second sheet passage sensor 17 and the first protrusion 43 of the lever 41 of the first sheet passage sensor 16 in this order.

When the sheet P passes the second sheet passage sensor 17, the sheet P contacts the first protrusion 43 of the lever 48. Thereby, the lever 48 moves to the second position. The light blocking portion 45 of the lever 48 blocks the detection light of the optical sensor 26 and the detection signal is not transmitted. Thereby, the second sheet passage sensor 17 is turned on. The controller 19 determines that the lever 48 is located at the second position (see timing G in FIG. 9).

When the sheet P passes the first sheet passage sensor 16, the sheet P contacts the light blocking portion 45 of the lever 41. Thereby, the lever 41 moves to the second position. The light blocking portion 45 blocks the detection light of the optical sensor 25 and the detection signal is not transmitted. Thereby, the first sheet passage sensor 16 is turned on. The controller 19 determines that the lever 41 is located at the second position (see timing H in FIG. 9).

6. Operations and Effects

According to the image forming apparatus 1, as shown in FIG. 9 and FIG. 14A, the first sheet passage sensor 16 is used as a sensor for detecting the first detection protrusions 52 of the drum cartridge 4.

Therefore, the image forming apparatus 1 determines whether the drum cartridge 4 is a new product or a used product by using the first sheet passage sensor 16.

As a result, the number of components is reduced and the image forming apparatus 1 can be downsized.

Further, according to this drum cartridge 4, as shown in FIG. 3 and FIG. 4, the transmission gear 50 for transmitting driving force to the first detection gear 51 is attached to the first conveying roller 27, and the transmission gear 50 rotates together with the first conveying roller 27.

Therefore, the first conveying roller 27 transmits driving force via the transmission gear 50 to the first detection gear 51.

As a result, the number of components is reduced and the image forming apparatus 1 can be downsized.

7. Modifications

While the disclosure has been described in detail with reference to the above aspects thereof, it would be apparent to those skilled in the art that various changes and modifications may be made therein without departing from the scope of the claims.

In the embodiment described above, the second protrusion 44 configured to contact the first detection protrusions 52 of the drum cartridge 4 is provided at the first sheet passage sensor 16. In the first direction, the second protrusion 44 is located at the opposite side of the other end 11B of the transfer roller 11 with respect to the one end 11A of the transfer roller 11.

In contrast, in the first direction, the second protrusion 44 may be located at the opposite side of the one end 11A of the transfer roller 11 with respect to the other end 11B of the transfer roller 11.

The second protrusion 44 may be provided at the second sheet passage sensor 17. In this case, in the first direction, the second protrusion 44 may be located at the opposite side of the other end 11B of the transfer roller 11 with respect to the one end 11A of the transfer roller 11. Or, in the first direction, the second protrusion 44 may be located at the opposite side of the one end 11A of the transfer roller 11 with respect to the other end 11B of the transfer roller 11.

In the embodiment described above, two first detection protrusions 52 are provided. However, one first detection protrusion or three or more first detection protrusions may be provided.

In the embodiment described above, the transmission gear 50 is a worm, the first detection gear 51 is a worm wheel, and the transmission gear 50 and the first detection gear 51 constitute a worm gear. However, the transmission gear 50 and the first detection gear 51 may be a bevel gear.

In the embodiment described above, the first detection gear 51 includes the gear portion 51A and the toothless portion 51B. Thereby, the first detection gear 51 is configured to move from the position where the first detection gear 51 engages the transmission gear 50 to the position where engagement with the transmission gear 50 is released. However, the first detection gear 51 does not necessarily need to include the toothless portion 51B. In this case, the first detection gear 51 may be configured to, as the first detection gear 51 rotates, separate from the transmission gear 50 and engagement with the transmission gear 50 is released.

What is claimed is:

1. An image forming apparatus comprising:

a main casing comprising:

a driving source;

a first sheet passage sensor for detecting a sheet; and a detecting sensor;

a drum cartridge detachably mounted on the main casing, the drum cartridge comprising:

a photosensitive drum being rotatable about a first axis extending in a first direction;

a first detection gear being rotatable by receiving driving force from the driving source; and a first detection protrusion being rotatable together with the first detection gear, the first detection protrusion being arranged to contact the first sheet passage sensor; and a developing cartridge detachably mounted on the drum cartridge, the developing cartridge comprising:

a developing roller;

a second detection gear being rotatable by receiving driving force from the driving source; and a second detection protrusion being rotatable together with the second detection gear, the second detection protrusion being arranged to contact the detecting sensor, wherein the drum cartridge further comprises a transmission gear configured to transmit driving force from the driving source to the first detection gear and to engage the first detection gear;

wherein the transmission gear is rotatable about a second axis extending in the first direction; and wherein the first detection gear is rotatable about a third axis extending in a second direction perpendicular to the first direction.

2. The image forming apparatus according to claim 1, wherein an outer diameter of the first detection gear is larger than an outer diameter of the transmission gear.

3. The image forming apparatus according to claim 1, wherein, in a state where the developing cartridge is mounted on the drum cartridge, the first detection gear is located between the developing cartridge and the first sheet passage sensor in the second direction.

4. The image forming apparatus according to claim 3, wherein the drum cartridge comprises a first conveying roller is rotatable about the second axis;

wherein the main casing comprises a second conveying roller is rotatable by receiving driving force from the driving source, the second conveying roller for conveying a sheet toward the photosensitive drum in cooperation with the first conveying roller;

wherein, in a state where the drum cartridge is mounted on the main casing, the first conveying roller is in contact with the second conveying roller and is configured to rotate along with rotation of the second conveying roller; and wherein the transmission gear is rotatable about the second axis, the transmission gear being attached to the first conveying roller and being rotatable together with the first conveying roller.

5. The image forming apparatus according to claim 4, wherein the first detection gear comprises a worm wheel; and wherein the transmission gear comprises a worm.

6. The image forming apparatus according to claim 4, wherein the third axis extends in a direction in which the second conveying roller and the first conveying roller are arranged.

7. The image forming apparatus according to claim 1, wherein the first detection gear is configured to move from a position at which the first detection gear engages the transmission gear to a position at which engagement with the transmission gear is released.

8. The image forming apparatus according to claim 7, wherein the first detection gear comprises:

a gear portion configured to engage the transmission gear; and a toothless portion configured not to engage the transmission gear.

9. The image forming apparatus according to claim 1, wherein the first detection protrusion comprises a plurality of first detection protrusions located spaced away from each other in a rotational direction of the first detection gear.

10. The image forming apparatus according to claim 1, wherein the drum cartridge further comprises a cover that covers the first detection gear, the cover being located between the developing cartridge and the first detection gear in a state where the developing cartridge is mounted on the drum cartridge.

11. The image forming apparatus according to claim 10, wherein the cover has a boss that rotatably supports the first detection gear.

12. The image forming apparatus according to claim 1, wherein the drum cartridge comprises a protection wall that is located between the first sheet passage sensor and the first detection gear in a state where the drum cartridge is mounted on the main casing, the protection wall having an opening;

wherein the first detection protrusion is exposed through the opening; and wherein a peripheral portion of the first detection gear is covered by a periphery of the opening in the protection wall.

13. The image forming apparatus according to claim 1, wherein the first sheet passage sensor comprises:

a lever is movable between a first position and a second position; and an optical sensor configured to detect movement of the lever from the first position to the second position; and wherein the first detection protrusion is arranged to contact the lever.

14. The image forming apparatus according to claim 13, further comprising a transfer roller that extends in the first direction and that contacts the photosensitive drum, wherein the lever comprises:

a main body extending in the first direction;

a first protrusion configured to contact a sheet, the first protrusion extending from the main body, the first protrusion being located between one end and an other end of the transfer roller in the first direction; and a second protrusion configured to contact the first detection protrusion, the second protrusion extending from the main body, the second protrusion being located at an opposite side of the other end of the transfer roller with respect to the one end of the transfer roller in the first direction.

15. The image forming apparatus according to claim 13, wherein the main casing comprises a controller configured to control the driving source; and wherein the controller is configured to, in a state where the driving source does not drive the first detection gear:

drive the driving source when the optical sensor detects that the lever is located at the first position; and not drive the driving source when the optical sensor detects that the lever is located at the second position.

16. The image forming apparatus according to claim 13, wherein the main casing comprises a controller; and wherein the controller is configured to:

when the optical sensor detects a signal of a particular pattern, determine that the drum cartridge is a new product; and when the optical sensor does not detect the signal of the particular pattern, determine that the drum cartridge is a used product.

17. A drum cartridge comprising:

a photosensitive drum being rotatable about a first axis extending in a first direction;

a first conveying roller being rotatable about a second axis extending in the first direction, the first conveying roller conveying a sheet;

a first detection gear being rotatable;

a first detection protrusion being rotatable together with the first detection gear; and a transmission gear configured to transmit driving force to the first detection gear, the transmission gear being attached to the first conveying roller, the transmission gear being rotatable about the second axis together with the first conveying roller, wherein the first detection gear is rotatable about a third axis extending in a second direction perpendicular to the first direction.

18. The drum cartridge according to claim 17, wherein an outer diameter of the first detection gear is larger than an outer diameter of the transmission gear.

19. The drum cartridge according to claim 17, wherein the transmission gear is configured to engage the first detection gear.

20. The drum cartridge according to claim 19, wherein the first detection gear comprises a worm wheel; and wherein the transmission gear comprises a worm.

21. The drum cartridge according to claim 19, wherein the first detection gear is movable from a position at which the first detection gear engages the transmission gear to a position at which engagement with the transmission gear is released.

22. The drum cartridge according to claim 21, wherein the first detection gear comprises:

a gear portion configured to engage the transmission gear; and a toothless portion configured not to engage the transmission gear.

23. The drum cartridge according to claim 17, wherein the first detection protrusion comprises a plurality of first detection protrusions located spaced away from each other in a rotational direction of the first detection gear.

24. The drum cartridge according to claim 17, further comprising:

a developing cartridge comprising a developing roller, the developing cartridge being detachably mounted on the drum cartridge; and a cover that covers the first detection gear, the cover being located between the developing cartridge and the first detection gear in a state where the developing cartridge is mounted on the drum cartridge.

25. The drum cartridge according to claim 24, wherein the cover has a boss that rotatably supports the first detection gear.

26. The drum cartridge according to claim 24, further comprising a protection wall that is located at an opposite side of the developing cartridge with respect to the first detection gear in a state where the developing cartridge is mounted on the drum cartridge, the protection wall having an opening;

wherein the first detection protrusion is exposed through the opening; and wherein a peripheral portion of the first detection gear is covered by a periphery of the opening in the protection wall.

* * * * *